US005421167A

United States Patent [19]

Verma

[11] Patent Number: 5,421,167

[45] Date of Patent: Jun. 6, 1995

[54] ENHANCED OLEFIN RECOVERY METHOD

[75] Inventor: Vijender K. Verma, Sugar Land, Tex.

[73] Assignee: The M. W. Kellogg Company, Houston, Tex.

[21] Appl. No.: 221,908

[22] Filed: Apr. 1, 1994

[51] Int. Cl.[6] ..... F25J 3/02

[52] U.S. Cl. ..... 62/24; 62/28

[58] Field of Search ..... 62/24, 28

[56] References Cited

U.S. PATENT DOCUMENTS

| | | | |
|---|---|---|---|
| 3,607,963 | 9/1971 | Dannell et al. | 62/39 |
| 3,635,038 | 1/1972 | Nagel et al. | 62/28 |
| 3,675,435 | 7/1972 | Jackson et al. | 62/26 |
| 4,331,461 | 5/1982 | Karbosky et al. | 62/28 |
| 4,401,450 | 8/1983 | Schramm | 62/13 |
| 4,430,102 | 2/1984 | Tedder | 62/24 |
| 4,900,347 | 2/1990 | McCue, Jr. et al. | 62/24 |
| 5,253,479 | 10/1993 | Di Cintio et al. | 62/23 |

*Primary Examiner*—Ronald C. Capossela
*Attorney, Agent, or Firm*—John P. Ward

[57] ABSTRACT

An enhanced method is disclosed for recovering olefins from a cracking furnace effluent stream in an olefins plant. In accordance with this method, a liquid hydrocarbon stream, preferably obtained from the compressor area drier liquids and/or from the deethanizer or depropanizer, is injected into the reaction effluent stream to condition the reaction effluent stream for enhanced condensation against propylene refrigeration. Also disclosed is an olefins plant utilizing liquid hydrocarbon injection and an improvement to existing olefins recovery process technology using liquid hydrocarbon injection for vapor stream conditioning.

22 Claims, 2 Drawing Sheets

ENHANCED OLEFIN RECOVERY METHOD

FIELD OF THE INVENTION

The present invention relates to enhanced olefins recovery in an olefins plant wherein a liquid hydrocarbon conditioning stream is injected into a cracking furnace effluent stream to reduce refrigeration energy consumption.

BACKGROUND OF THE INVENTION

Ethylene is a ubiquitous building block in the manufacture of a wide variety of chemical and plastic products. Ethylene is typically produced industrially by pyrolysis of hydrocarbons in a furnace in the presence of steam. The furnace effluent stream comprising a range of components is typically cleaned up, dried to remove water, compressed and passed to an olefins recovery section to condense the ethylene and other condensable heavy end components (ethane, propylene, propane, etc.). The condensed stream is then distilled to remove the light ends (methane and hydrogen) and fractionated to separate ethylene from the heavy ends.

Compositional range of the furnace effluent stream depends on several factors including the type of hydrocarbon feedstock used. A representative composition of the effluent of a furnace employing three different hydrocarbon feedstocks and operated to maximize ethylene formation is given in Table 1.

TABLE 1

| | Effluent Composition (mole %) Furnace Feedstock | | |
|---|---|---|---|
| Component | Ethane | Propane | Naphtha |
| $H_2$ | 35.9 | 20.5 | 15.8 |
| $CH_4$ | 6.5 | 27.8 | 26.5 |
| $C_2H_4$ | 34.3 | 32.0 | 33.6 |
| $C_2H_6^+$ | 23.3 | 19.7 | 24.1 |

As can be seen, hydrogen and methane light end components comprise a substantial portion of the effluent. These light ends have an undesirable impact on the stream dew point temperature. Greater refrigeration power is required to condense out ethylene and other components from streams containing high hydrogen and methane concentration, and refrigeration makes up a significant portion of the process energy requirements. Additionally, in existing plants ethylene refrigeration availability may be limited and therefore a process bottleneck to any increase in ethylene output.

It would be desirable to compensate for the presence of light end components to obtain greater condensation against propylene refrigeration. As far as applicant is aware, in an ethylene plant employing hydrocarbon pyrolysis, it has been heretofore unknown to reinject liquid hydrocarbons, particularly $C_2$-lean liquid hydrocarbons from the liquid driers, deethanizer and/or depropanizer into the reactor effluent stream for the purpose of raising the stream dew point temperature, lowering refrigeration energy usage and shifting cooling requirements from ethylene refrigeration to propylene refrigeration.

SUMMARY OF THE INVENTION

Injection of liquid hydrocarbons into the reactor effluent stream prior to the bulk of the refrigeration imput in an olefins plant can raise the dew point temperature of condensing streams and shift refrigeration requirements from relatively colder ethylene refrigeration to relatively warmer propylene refrigeration to reduce energy usage. The injected liquid can comprise drier liquids condensed from the furnace effluent following the compression area, condensate recovered from the chilling train, $C_2$-lean products recycled from the deethanizer and/or depropanizer distillation columns or combinations thereof. In addition, the liquid hydrocarbon can be from an outside source such as propane and/or propylene introduced into the process.

In one embodiment, the present invention provides a method for recovering olefins from any stream of light hydrocarbons containing hydrogen and methane, but preferably a suitably treated cracking furnace effluent stream. In one step, a liquid hydrocarbon conditioning stream is injected into the furnace effluent stream to form a conditioned stream. In another step, olefins from the conditioned stream are condensed and recovered through a series of chilling and vapor-liquid separation steps. The condensed olefins are further treated in a methane separator to separate methane and hydrogen. The liquid hydrocarbon conditioning stream comprises a drier liquid stream, $C_2$-lean deethanizer bottoms stream, $C_2$-lean depropanizer overhead or bottoms stream, or a combination thereof. Preferably, olefins and heavier components in the conditioned stream are partially condensed and recovered in a propylene refrigerant primary chilling and vapor-liquid separation step to form a primary lean vapor stream and a primary olefins condensate stream. Olefins from the primary lean vapor stream are then further condensed in successive chilling and separation steps.

In a preferred embodiment, the methane separator can comprise a demethanizer distillation column. The primary condensed olefins stream can be stripped of methane and lighter components in a prestripper or fed to the demethanizer distillation step.

The present method also can be practiced in a depropanizer-first arrangement. In the depropanizer-first arrangement, $C_{4+}$ components are substantially separated from the treated furnace effluent stream prior to the liquid injection step. In the depropanizer-first arrangement, the primary olefins condensate stream is preferably stripped in the prestripper to produce an enriched condensate stream and a secondary lean vapor stream. The enriched condensate stream is then fed to a deethanizer. The secondary lean vapor stream is fed to the methane separator.

In another embodiment, the present invention provides an olefins plant comprising a furnace unit for cracking hydrocarbons and producing an effluent stream comprising hydrogen and olefins. The plant includes a line for injecting a liquid hydrocarbon conditioning stream into the effluent stream and producing a conditioned stream having a lower vapor content at primary refrigerant temperature. A series of cascaded condensers and vapor liquid separators are adapted to condense and recover olefins from the conditioned stream. The plant also includes a methane separator such as a demethanizer distillation column for removing methane from the condensed olefins, and a refrigeration system for supplying the primary refrigerant to one or more of the cascaded condensers. The olefins plant preferably includes a unit for treating the furnace effluent stream upstream from the liquid injection line. The treating unit includes a compressor and a drier in series, optionally with a cooler, a chiller, an acid gas removal unit or a combination thereof. The olefins plant preferably comprises a primary condenser operatively associated with a primary vapor-liquid separator for partially condensing olefins from the conditioned stream to produce a primary lean vapor stream for feed to the cascaded condensers and separators.

The olefins plant can use a deethanizer-first or a depropanizer-first scheme, that is, the plant can include a distillation unit for substantially separating $C_2$ or $C_3$, respectively, and heavier components from the treated furnace effluent before the liquid hydrocarbon conditioning line.

In another embodiment of the olefins plant, a series of cascaded cross-exchangers are preferably provided for partially condensing olefins from a portion of the furnace effluent stream by heat exchange against the cooled olefins-lean vapor and recovered hydrogen and methane streams. Preferably, an expander is provided to expand and further cool the olefins-lean vapor and lines are provided for directing the cooled olefins-lean vapor and recovered hydrogen and methane streams as heat exchange media to the cross-exchangers.

A further embodiment of the present invention provides an improvement to a method for recovering olefins from a cracking furnace effluent stream containing olefins. The method includes the steps of condensing and recovering olefins from the furnace effluent stream through a series of chilling and vapor-liquid separation steps, including partially condensing olefins and heavier components from the furnace effluent stream in a primary chiller and recovering condensed olefins and lean vapor in a primary vapor-liquid separator and condensing and recovering olefins from the lean vapor stream through a series of secondary chilling and vapor-liquid separation steps, and distilling the recovered olefins in a demethanizer. The improvement comprises the step of injecting a liquid hydrocarbon conditioning stream into the furnace effluent stream prior to the olefin condensation steps.

DETAILED DESCRIPTION OF THE INVENTION

In the present invention, liquid hydrocarbons condensed from the various process units (e.g. the compression unit, deethanizer, depropanizer, chilling train, etc.) can be reinjected at one or more locations upstream from a methane separation unit of a chilling train to effect stream conditioning and increase the amount liquids condensed against warmer temperature refrigerants such as propylene refrigeration.

Figure 1:
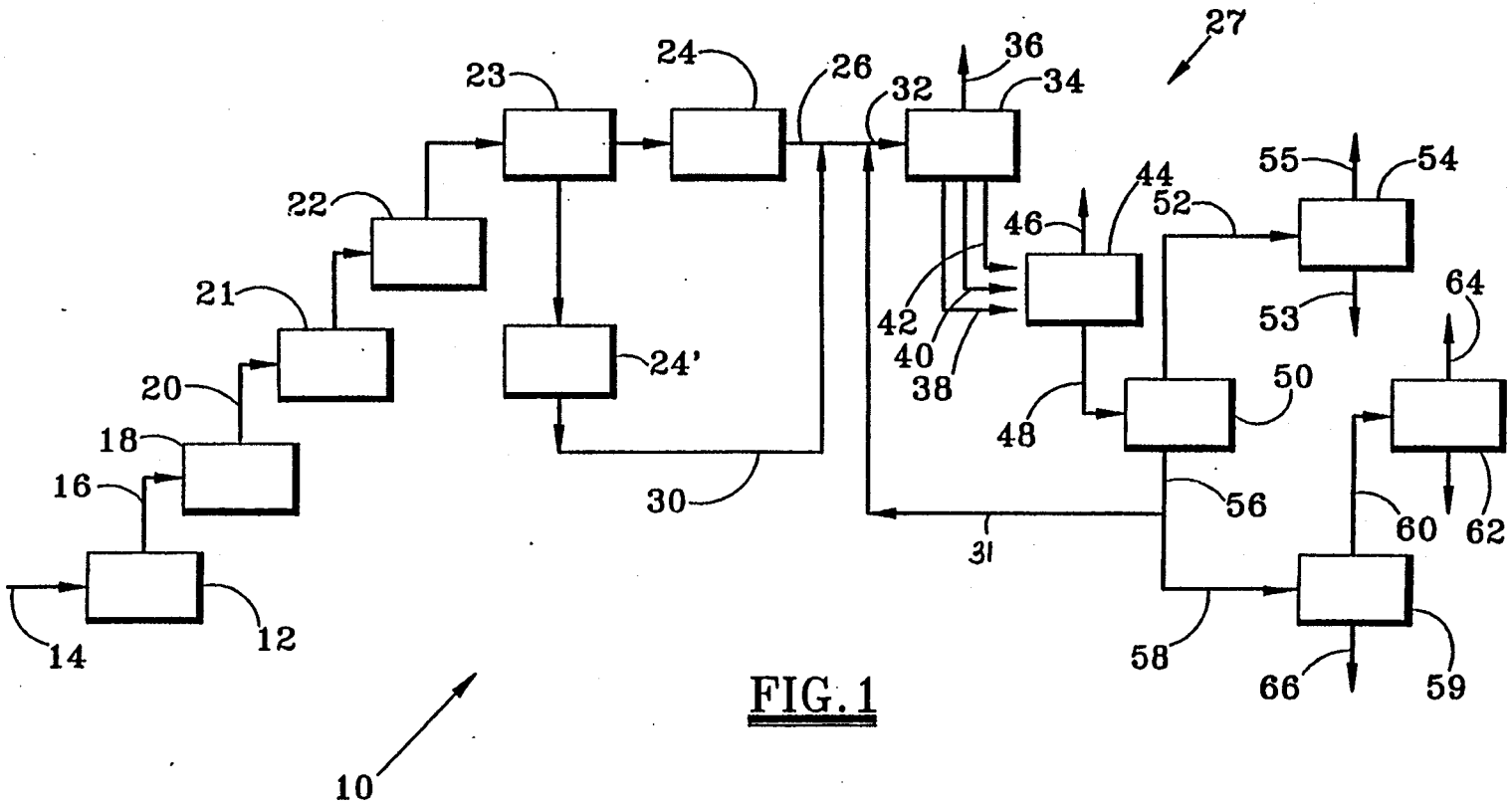
FIG. 1 is a flow diagram of an ethylene plant of the present invention including injection of a liquid hydrocarbon conditioning stream to the chilling train, wherein the conditioning stream comprises a $C_2$-lean stream recycled from the deethanizer and/or the drier liquids from the compressor area and the plant has a demethanizer-first arrangement.
Figure 2:
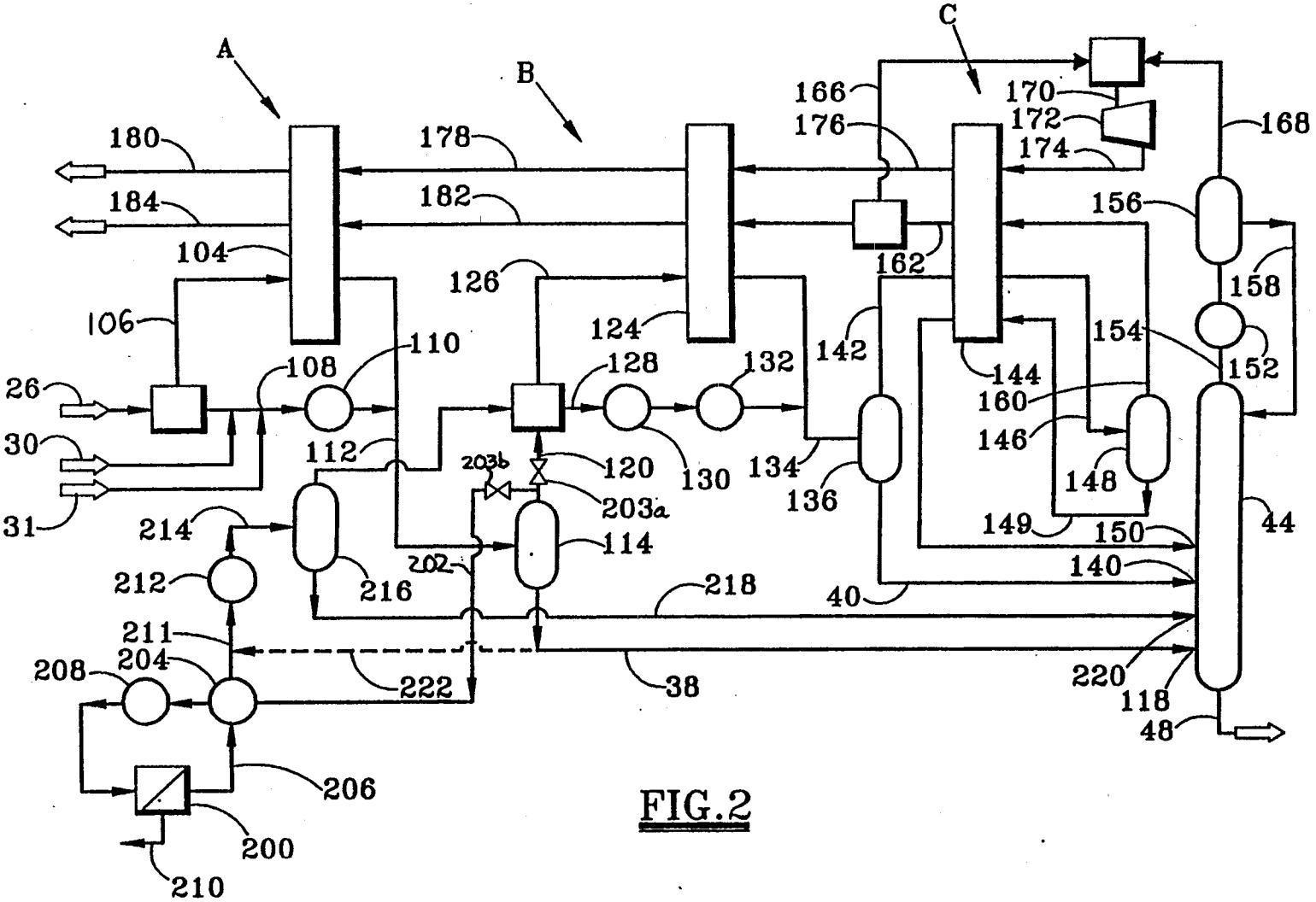
FIG. 2 is a schematic diagram of the chilling train of an ethylene plant of FIG. 1 including a membrane hydrogen separator unit.

Referring to FIGS. 1–2, wherein like referenced parts have like numerals, an olefins production plant 10 of the present invention comprises a cracking furnace 12 having reaction tubes (not shown) and a feed line 14 for the introduction of a hydrocarbon feedstock such as ethane, propane, butane, naphthas, gas oil, other petroleum fractions or combinations thereof. As is well known in the petrochemical arts, the hydrocarbon feedstock is conventionally cracked by pyrolysis in the presence of steam to produce a raw multicomponent effluent stream 16 comprising olefins such as ethylene, propylene, butadiene, and the like. The raw effluent stream 16 also contains hydrogen, steam, and a range of hydrocarbon reactants and byproducts including methane, ethane, propane, butane, etc. The raw effluent stream 16 has a composition and yield which are dependent on several factors including feedstock type, steam content, conversion rate, and furnace temperature, pressure, residence time, severity, etc.

Following production in the furnace 12, the raw effluent stream 16 is cooled in a heat recovery zone 18 generally by steam generation and/or one or more quenches with water and/or hydrocarbon streams wherein process heat can be recovered for other uses. The raw, quenched effluent 20 can be optionally distilled in a primary fractionation cooling zone (not shown) to separate heavy fractions and to knock out steam condensate. Following any primary fractionation and/or cooling quenching steps, the vapors are compressed in first-compression zone 21 to a pressure suitable for an acid gas removal zone 22 for removing $H_2S$ and $CO_2$, if necessary. The acid gas removal zone 22 generally comprises conventional scrubbers using agents such as caustic and/or amines. The desulfurized effluent is then compressed in a second compression zone 23 to a pressure suitable for subsequent cryogenic olefins recovery—typically to a final pressure of from about 2.0 to about 5.0 MPa. As used herein, all pressures are denoted as absolute pressure unless gauge pressure is indicated. Following compression and acid gas removal, the gas is generally dried to remove residual water using a desiccant such as a molecular sieve, for example, in a drier 24 to prevent the formation of ice or hydrates during subsequent cooling. The dried furnace effluent vapor stream 26, thus treated for sulfur and water removal and compressed, is passed to an olefins recovery train 27. In the olefins recovery train, as described hereinbelow, the treated furnace effluent stream 26 is typically separated into its various components including methane, ethane, ethylene, propane, propylene, butane, and the like.

In the practice of the present invention, the treated furnace effluent stream 26 is conditioned for enhanced olefins recovery against warmer temperature refrigerants such as propylene refrigeration by injection of a liquid hydrocarbon conditioning stream. The conditioning stream can comprise any liquid hydrocarbon process stream comprised mostly of $C_3$ and heavier components. One such available liquid hydrocarbon stream includes a drier liquid stream 30 comprising hydrocarbon liquids produced during compression and/or primary fractionation and dried in a drier 24'. Additional liquid hydrocarbon conditioning streams are those $C_2$-lean streams which are recovered following processing for olefins separation.

As seen in FIG. 1, the drier liquid stream 30, and/or a liquid hydrocarbon stream 31 recycled from the downstream olefins recovery train 27 are reinjected into the treated effluent stream 26 to form conditioned stream 32 for feed to the chilling train 34. The overall amount of liquid hydrocarbon stream(s) recycled and reinjected should be sufficient to enhance liquid dropout against warmer refrigeration, but not so great as to excessively increase the size of the downstream separation equipment and associated heat exchangers.

The conditioned stream 32 is chilled in a cascaded chilling train 34 against refrigerants such as other process streams and/or propylene and ethylene using a cascaded series of condensation stages. The condensate is then separated from the vapor in a respective knockout drum and the remaining gas is sent on for further treatment, e.g. further condensation, refrigeration recovery and/or hydrogen recovery. Three or more cascaded cooling stages are typically used. Cooling in the condensation stages is generally (but not necessarily) divided between a process cross-exchanger for an exchange of heat against one or more cold process streams and a refrigeration condenser for an exchange of heat against a refrigerant. The proportion of the split between the process cross-exchanger and the refrigeration condenser will depend on the amount of cooling available from the cold process stream(s).

A light end hydrogen-rich vapor stream 36 recovered from the chilling train 34 is typically used as a fuel or for hydrogen recovery. Several $C_{2+}$ condensate streams 38, 40, 42 formed at the various cascaded stages of the chilling train 34 are fed to a methane separation unit 44 which is preferably a demethanizer distillation column to separate residual light ends components (methane and hydrogen). A methane and residual hydrogen stream 46 is taken off overhead and can also be used for a fuel. A $C_{2+}$ bottoms stream 48 is fed to a deethanizer 50. In the deethanizer 50, $C_2$'s are separated from $C_{3+}$ components. A $C_2$'s stream 52 is fed overhead to an ethylene-ethane splitter 54 for fractionation in to an ethylene product stream 55 overhead and an ethane stream 53 recovered as a bottoms product.

A portion of the deethanizer bottoms stream 56 comprising $C_{3+}$ components or another $C_2$-lean deethanizer side stream (not shown) is recycled as the liquid hydrocarbon conditioning stream 31 for reinjection into the treated furnace effluent stream 26. Deethanizer bottoms not recycled can be fed through line 58 to a depropanizer 59. In the depropanizer 59, $C_3$'s are separated from $C_{4+}$ components. The $C_3$'s stream 60 can be fed to a propylene-propane splitter 62 for splitting a propylene product stream 64 overhead. The $C_{4+}$ component bottoms stream 66 removed from the depropanizer 59 can be fed for further fractionation and recovery of heavier components as well known in the art.

Further details of the conditioning steps, and the operation of the chilling train 34 and the methane separation unit 44, are shown in FIG. 2. The chilling train 34 comprises a primary chilling and vapor-liquid separation stage A using process streams and/or liquid propylene as the primary refrigerant. Vapor not condensed stage A is passed to additional cascaded chilling and separation stages B and C wherein ethylene is the primary refrigerant.

The first separation stage A can include one or more cross-exchanger precoolers (not shown) comprising the reboilers of one or more downstream fractionation columns (such as the ethylene-ethane splitter). A portion of the gas stream 26, generally minor, is directed through line 106 to a cross-exchanger 104 and the remaining portion is preferably injected with the liquid hydrocarbon streams 30, 31 to form a conditioned stream 108 for enhanced olefins condensation against propylene refrigeration. The conditioned stream 108 is then directed to a first condenser 110 for partially condensing condensable olefin components therefrom. The cooled streams from the condenser 110 and cross-exchanger 104 are recombined and directed through line 112 to a first vapor-liquid separator drum 114.

Chilling and conditioning of the mixed-phase feed to the first vapor-liquid separator drum 114 can generally occur in any order, including refrigeration in line 26 prior to or after the injection from lines 30 and 31. Where the conditioned stream 112 is at the lowest temperature feasible (usually −37° to −40° C.) with a low-level refrigerant, e.g. propylene refrigerant, and contains the highest economic level of liquid reinjection, the quality of uncondensed vapor from the separator drum 114 will be at a minimum and will require less high-level refrigerant, e.g. ethylene refrigerant.

Olefins condensate from the bottom of the first drum 114 is fed through line 38 to a relatively lower feed point 118 on the demethanizer 44. Lean vapor from the drum 114 is directed through line 120 to a second condensation stage B wherein ethylene refrigerant is used. Similar to the first stage A, the vapor is divided with a portion directed to a second cross-exchanger cooler 124 through line 126 with the remaining portion passed though line 128 to condensers 130 and 132. The partially condensed split streams thus cooled are recombined and passed through line 134 to a second vapor-liquid separator drum 136. Separated condensate from the second drum 136 is directed through line 40 to the demethanizer 44 at an intermediate feed point 140.

The condenser 130 typically operates at a temperature on the order of −60° C. corresponding to the ethylene refrigerant at about −63° C. The condenser 132 typically operates at a temperature on the order of −83° C. corresponding to the ethylene refrigerant at about −86° C. The pressure of the second condensation stage B is preferably similar to the pressure of the first condensation stage A (2.0 to 5.0 MPa).

Vapor from the second drum 136 is introduced through line 142 to a final condensation stage C wherein the primary refrigerant is preferably the lowest level of ethylene refrigerant and/or one or more cold process gas streams. From the drum 136, the vapor is preferably directed in full to a third cross-exchanger 144 wherein most of the methane and essentially all of the $C_2$ and heavier remaining condensable components are condensed by an exchange of heat with ethylene refrigerant and chilled process gas streams, e.g. light ends which are not condensed in the olefins recovery process. A partially condensed chilled stream 146 from the cross-exchanger 144 is passed to a third vapor-liquid separator drum 148. A condensate stream 149 separated in the third drum 148 is first preferably passed through the cross-exchanger 144 as a cooling liquid. A partially heated third condensate stream is then fed via line 42 to the demethanizer 44 at a relatively higher feed point 150.

In an alternative embodiment of the present invention, dephlegmator type devices can be employed in separation stages B and C in place of the cross-exchangers 124 and 144 discussed above.

The demethanizer 44 as known in the art can be a distillation column containing conventional internal vapor/liquid contacting devices such as, for example, packing shapes or trays. Overall dimensions and number of trays are specified by standard design criteria which in turn depend on composition of the several condensate feeds. The demethanizer shown in FIG. 2 operates substantially at the same pressure as the cascaded condensers so that the reflux liquid can be provided by an overhead partial condenser 152 using ethylene refrigerant. Alternatively, the demethanizer can be operated at a lower pressure using methane refrigerant. Overhead vapor from the demethanizer 44 is passed through line 154 to the condenser 152 wherein ethylene refrigerant is preferably used to condense condensable components. A partially condensed demethanizer overhead is passed to a condensate knock-out drum 156. Condensate recovered from the overhead stream is recycled as reflux liquid to the demethanizer 44 through line 158. Cold overhead vapor components comprising light ends (mostly methane) separated from the olefin and heavy component liquids are directed, either with or without expansion in expansion stage 172, to the cross-exchange coolers 144, 124, and/or 104 as a cooling medium for recapture of a portion of the cooling energy. Note that any pressure can be selected for the operation of the demethanizer 44, and various other methods of providing reflux can be used in the present invention. Also, any excess reflux provided by the overhead partial condenser 152 can be used as refrigerant in exchanger 144.

The bulk of the demethanizer vaporization heat for vapor reflux is provided by a reboiler (not shown). The demethanizer reboiler can use a conventional low temperature heating medium such as propylene refrigerant to recover refrigeration.

Bottoms liquid comprising olefins and heavy ends from the demethanizer 44 is directed through line 48 for fractionation into individual components in a conventional refining zone such as shown in FIG. 1 comprising the deethanizer 50, $C_2$ splitter 54, depropanizer 59, etc. as mentioned above.

Cold noncondensable vapor from the third drum 148 typically comprises hydrogen at an initial temperature of about −135° C., and may be further processed to improve hydrogen purity, for example, in one or more cascaded cooling zones (not shown). With or without such additional processing, the vapor is preferably used in a cascaded fashion as cooling media in the cross-exchangers 104, 124, 144. The vapor from the third drum 148 is passed through line 160 as a cooling medium in the cross-exchanger 144 and then through lines 162 and 164 as a cooling medium in the cross-exchanger 124. However, a portion or all of the stream 162 can be diverted through line 166 and combined with the cold light ends gas stream in line 168, comprising primarily methane with some hydrogen and carbon monoxide from the demethanizer 44. The combined stream 170 can be further cooled by expansion to a pressure of about 0.5 MPa, for example, in a turbine expander 172 to increase cooling capacity of the stream and recover power from the expansion. The proportion of the stream 162 diverted into line 166 generally depends on the chilling process cooling balance in accordance with standard engineering concepts.

The expanded, cooled stream from the expander 172 is directed through line 174 to cross-exchanger 144 as an additional cooling medium, and then through line 176 to exchanger 124 and through line 178 to exchanger 104. At least a portion of the expanded, cooled stream from the expander 172 also can be employed as an additional cooling medium for the overhead vapor from demethanizer 44 in an exchanger means (not shown) located downstream of condenser 152 and upstream of knock-out drum 156. A methane-rich fuel gas stream is recovered in line 180. The remaining hydrogen from line 162 is passed through line 164 preferably to the cross-exchanger 124 as a cooling medium and through line 182 to the cross-exchanger 104 to provide a hydrogen-rich product in line 184.

The present olefin recovery process can include an optional membrane separator unit 200. The membrane separator can reject a substantial portion of the hydrogen contained in the furnace effluent stream (see Table 1 for a representative composition). The membrane separator unit 200 is preferably installed early in the chilling process 34 prior to the bulk of the refrigeration input in order to raise the effluent stream dew point temperature as early as feasible. The membrane separator 200 can be installed at other locations in the present olefins recovery process, but a location following the first condensate separation drum 114 is preferred because partial pressure of hydrogen is higher and overall flow is lower since a large portion of $C_2$'s and heavier components have already been condensed and removed. Following hydrogen rejection, a hydrogen-lean stream produced can be further chilled against propylene refrigerant to drop out additional liquids before being passed to the subsequent cascaded refrigeration stages B, C.

As seen in FIG. 2, all or part of the hydrogen-rich vapor from the first drum 114 is passed from line 120 to the membrane separator 200 via line 202. Valves **203*a* and 203*b* control flow to the membrane separator 200. Prior to the membrane separator 200, however, the vapor from the drum 114 is generally heated to suitable membrane operating conditions. Vapor in line 202 is preferably heated initially in a cross-exchanger 204 by an exchange of heat first against a hydrogen-lean impermeate stream 206 and then in a heater 208** by an exchange of heat against a suitable heating medium such as, for example, steam or hot water.

The membrane separator can comprise any membrane system which is substantially permeable for hydrogen and substantially impermeable for ethylene and heavier hydrocarbons. The membrane should also have other suitable characteristics including compatibility with the process stream, structural strength to endure high transmembrane pressure differential, an adequate flux for given separation parameters, and the like. Membrane systems which may be suitable are available commercially from various manufacturers and under various tradenames, such as, for example, UOP, Hydranautics, Toray, Toyobo, DuPont, Permasep, Aschi, Eltech Systems, Occidental Chemicals, Oxytech Systems, Monsanto, Medal, Dow Chemical, W. R. Grace, Separex, Delta Engineering, Ube and the like. A hydrogen-rich permeate stream is obtained via line 210. Gas which does not permeate the membrane separator exits through line 206. Further information regarding the membrane hydrogen separation unit 200 is described in commonly assigned U.S. Ser. No. 08/222,205, "Olefin Recovery Method," filed on Apr. 1, 1994, which is hereby incorporated herein by reference.

The hydrogen-lean stream from the exchanger 204 is directed through line 211 to a post-membrane condenser 212 for further cooling and liquid condensation. The post-membrane condenser 212 also preferably cools against −40° C. or warmer propylene refrigerant and the resulting partially condensed stream preferably flows through line 214 into a post-membrane vapor-liquid separator drum 216. Condensate from the drum 216 generally has a lower bubble point temperature than condensate from the first stage drum 114, and is directed through line 218 to a lower intermediate feed point 220 of the demethanizer 44. Vapor from the drum 216 is fed to the second condensate stage B through line 224. Alternatively, drum 216 can be by-passed and the effluent from condenser 212 fed directly to the second condensation stage B.

The membrane separator can be located anywhere between the treating unit, i.e., the drier 24, and the demethanizer column 44. Where depropanizer-first and/or deethanizer-first schemes are used, the membrane separation unit 200 is preferably after the depropanizer and/or deethanizer.

In the practice of the present invention, an intermediate demethanizer condenser (not shown) can be used to enhance overall energy efficiency of the cryogenic distillation and extend energy savings realized by use of liquid hydrocarbon reinjection and/or membrane hydrogen separation. Use of the intermediate condenser adjacent the lowermost feed point 118 can improve the energy efficiency of the distillation column 44 by shifting condensation cooling duty from the overhead condenser 152 to the intermediate condenser operating at a higher temperature. Thus, a lower quality refrigerant can be used as the cooling medium for the intermediate condenser, reducing the cooling duty on the overhead condenser 152 which requires colder refrigerant.

As other optional features, the first stage condensate stream 38 can be fed from the first drum 114 to the demethanizer 44 via a demethanizer feed prestripper column (not shown). An overhead prestripper condenser (not shown) preferably operating at about −37° C. using propylene refrigerant provides liquid reflux to the prestripper. An overhead olefins stream (not shown) leaving the prestripper is then fed to the demethanizer 44. A bottoms stream (not shown) comprising the $C_{2+}$ heavy components is withdrawn from the prestripper (not shown) for further processing.

In place of a prestripper, the condensate feed to the demethanizer 44 from the first condensate separation drum 114 can be subcooled.

When the membrane separator is used, hydrocarbon liquid from the first drum 114 (or any of the other liquid hydrocarbon source) can be reinjected through line 222 into the hydrogen-lean stream 211 prior to any additional chilling against the propylene refrigerant. In addition, the condensate from the membrane drum 216 can be prestripped and/or subcooled prior to feed to the demethanizer 44.

The present invention can be further described by reference to the following examples.

EXAMPLE 1

Computer simulations were undertaken on the present chilling train 34 (including the demethanizer and deethanizer) using ethane, propane and naphtha as feedstocks. Simulation parameters include reinjection of compressor area drier liquids and/or hydrogen rejection to determine a comparative degree of olefins knocked out against propylene refrigeration for each case and feedstock type. When the hydrogen rejection unit is employed, reinjection of first stage drum liquids is also considered. Standardized ethylene process flow diagrams are based on a demethanizer-first scheme conforming to FIGS. 1 and 2 except that a four-stage chilling train is used including a separate −100° C. ethylene refrigeration condenser and drum between chilling stages B and C. Yields for the feedstocks involved are based on actual plant results. Standard simulation methods were employed.

Simulation parameters include a 680 million kg/yr (1.5 billion lb/yr) production rate and a tolerable ethylene loss rate in the hydrogen rejection stream 210 of about 0.5 percent. Pressure of the inlet stream 26 following the compression zone is about 4.2 MPa (600 psia). Approximate composition of the inlet stream for the three feedstocks is given above in Table 1. For an ethane feedstock, composition of the membrane inlet stream is given in Table 2.

TABLE 2

| Component | Conc. (mole %) |
|---|---|
| $H_2$ | 52.97 |
| CO | 0.06 |
| $C_1$ | 8.04 |
| $C_2$ | 38.72 |
| $C_3$ | 0.17 |
| $C_4^+$ | 0.04 |

A typical commercially available, hollow-fiber membrane is assumed. The membrane operating temperature is set slightly lower than the manufacturer's maximum recommended temperature. A minimum reject hydrogen pressure is set so that the rejected hydrogen could be supplied to an existing fuel header without compression.

The amount of liquids condensed against propylene in the first condensation stage for the three feedstocks are given in Table 3 for the three cases simulated. Compressor area drier liquids reinjection is assumed except for the ethane feedstock in which case a low quantity of condensed liquids may not justify the economics.

The amount of liquids dropout against propylene refrigerant in the first condensation stage A is increased for the propane and naphtha feedstocks by compressing the incoming stream and reinjecting the compressor area drier liquids.

For the ethane case, the membrane is the most significant factor in increasing liquids dropout against propylene. For propane and naphtha, the membrane has a relatively small effect on increasing the amount of liquids dropout against propylene refrigerant in the first condensation stage, due in part to the fact that reinjection of dried liquid from the compressor area is very effective in dropping the liquid in the first drum. However, the amount of liquids dropout against propylene for these two cases is significantly increased by reinjecting the first drum liquids.

TABLE 3

| Case | Liquids dropout 1st drum 114 (kg/hr) | Liquids dropout membrane drum 216 (kg/hr) | Increase in liquids dropout over base case (kg/hr) | Increase in liquids dropout due to 1st drum 114 reinjection (kg/hr) |
|---|---|---|---|---|
| | Ethane Feedstock* | | | |
| Without membrane separator (base case) | 82,570 | — | — | — |
| With membrane separator | 87,020 | 45,120 | 49,570 | — |
| With membrane separator and 1st drum 114 reinjection | 87,020 | 136,580 | 54,010 | 4440 |
| | Propane Feedstock | | | |

TABLE 3-continued

| Case | Liquids dropout 1st drum 114 (kg/hr) | Liquids dropout membrane drum 216 (kg/hr) | Increase in liquids dropout over base case (kg/hr) | Increase in liquids dropout due to 1st drum 114 reinjection (kg/hr) |
|---|---|---|---|---|
| Without membrane separator (base case) | 127,820 | — | — | — |
| With membrane separator | 131,090 | 5320 | 8590 | — |
| With membrane separator and 1st drum 114 reinjection | 131,090 | 152,200 | 24,380 | 15,790 |
| | Naphtha Feedstock | | | |
| Without membrane separator (base case) | 156,220 | — | — | — |
| With membrane separator | 159,390 | 2170 | 5340 | — |
| With membrane separator and 1st drum 114 reinjection | 159,390 | 177,200 | 20,980 | 15,640 |

*no drier liquid reinjection.

EXAMPLES 2–4

An olefin plant computer simulation similar to the simulation performed in Example 1 was undertaken to determine the refrigeration power savings of reinjecting a $C_2$-lean deethanizer bottoms liquid stream 31 into the treated furnace effluent stream 26 except that the base case of this study was for an ethylene plant with an 80/20 ethane/propane feedstock and the production rate was 450 million kg/yr. Additional base case simulation assumptions are a 3-drum demethanizer-first chilling train and drier liquid reinjection.

In the simulation examples, liquid from the deethanizer bottoms is recycled to the front end of the demethanizer-first chilling train at reinjection rates of 0 kg/hr (Example 2), 18,200 kg/hr (40,000 lb, Example 3) and 36,400 kg/hr (80,000 lb/hr, Example 4). The deethanizer bottoms liquid is pumped, chilled to 15° C., and then mixed with the drier liquids before reinjection. Cooling water and cold propylene vapor are used as chilling media.

Results in terms of power requirements are given in Table 4. Due to the extra liquid (from the deethanizer bottoms), more $C_2$'s are condensed by cooling prior to the first drum including both the $C_2$ splitter cross-exchanger reboilers (located at the front of the chilling train) and the propylene refrigeration condenser. Therefore liquid from the first drum (−37° C.) contains more $C_2$'s and $C_2$'s to be condensed against ethylene refrigeration are considerably reduced. This lowers required ethylene refrigeration duty and power. Ethylene refrigeration condensing duty against −40° C. propylene refrigeration is also reduced.

The use of deethanizer bottoms liquid recycle results in the several changes in operating conditions.

TABLE 4

| Process Unit | Example 2 | Example 3 | Example 4 |
|---|---|---|---|
| | Deethanizer bottoms recycle rate (kg/hr) | | |
| (Refrigeration level and | 0 | 18,200 | 36,400 |

TABLE 4-continued

| type) | Heat Duties (MMKcal/hr) | | |
|---|---|---|---|
| Condenser (12° C., PR) | 1.37 | | 1.37 |
| Condenser 110 (−40° C., PR) | 29.38 | | 26.96 |
| Condenser 130 (−60° C., ER) | 2.16 | | 1.20 |
| Condenser 132 (−83° C., ER) | 1.84 | | 1.37 |
| Net $C_2$ Stripper Reboiler (−11/−18° C.) | 10.06 | | 7.00 |
| Deethanizer Condenser | 2.73 | | 3.52 |
| Demethanizer Stripper reboilers total (27° C.) | 2.35 | | 4.24 |
| Demethanizer Condenser 156 (−100° C., ER) | 0.77 | | 0.71 |
| Demethanizer Reboiler, (9° C.) | 2.66 | | 1.95 |
| | Power (kW) | | |
| ER | 2011 | 1715 | 1506 |
| PR | 13523 | 13175 | 13078 |
| Total | 15534 | 14890 | 14584 |
| Difference | — | 644 | 950 |
| Recycle pump | — | 24 | 48 |
| Net Difference (savings) | — | 620 | 902 |

PR = Propylene refrigeration
ER = Ethylene refrigeration

Demethanizer stripper bottoms temperature increases from 16° C. to 27° C. Consequently, not all of the reboil duty can be used for propylene refrigeration subcooling. The increased liquid rates can potentially increase the size of the demethanizer stripper.

Deethanizer condenser duty is increased from 2.91 to 3.52 MMkcal/hr. This is a 20 percent increase in the required reflux rate, however, the vapor flow increases only by 4 percent. The bottom deethanizer reboil duty is increased from 2.54 to 4.06 MMkcal/hr for a fixed side reboil duty of 4.0 MMkcal/hr. This may not be the optimum configuration for the deethanizer as more side reboil duty and/or more feed preheat may be possible. Also the preferred point from which the liquid recycle stream is taken may be changed from the bottoms to the side draw. The bottoms temperature does not change from 74° C. so fouling should not increase.

Ethylene refrigeration compressor power is reduced by 25 percent. Propylene refrigeration compressor also is reduced. This scheme can be useful for debottlenecking wherein the availability of ethylene refrigeration is a process limiting factor. Due to the low temperature in the chilling train, fouling should not increase due to the liquid recycle stream. Recycle of a deethanizer liquid stream for conditioning the furnace effluent stream is an efficient way to enhance energy savings of an existing plant and/or reduce bottlenecking due to limited ethylene refrigeration availability.

The present olefins recovery process is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

I claim:

1. A method for recovering olefins from a stream of light hydrocarbons containing methane and hydrogen, comprising the steps of:

injecting a liquid hydrocarbon conditioning stream into the light hydrocarbon stream to form a conditioned stream;

condensing and recovering olefins from the conditioned stream through a series of chilling and vapor-liquid separation steps; and separating methane and hydrogen from the olefins.

2. The method of claim 1, wherein the light hydrocarbon stream comprises a treated effluent stream from a cracking furnace.

3. The method of claim 2, wherein the liquid hydrocarbon conditioning stream comprises a drier liquid stream.

4. The method of claim 2, wherein the liquid hydrocarbon conditioning stream comprises a $C_2$-lean hydrocarbon stream.

5. The method of claim 2, wherein the liquid hydrocarbon conditioning stream comprises a $C_2$-lean deethanizer bottoms stream.

6. The method of claim 2, wherein the liquid hydrocarbon conditioning stream comprises a $C_2$-lean depropanizer stream.

7. The method of claim 2, comprising partially condensing and recovering olefins from the conditioned stream in a primary chiller and vapor-liquid separator to produce a primary lean vapor stream and a primary olefins condensate stream, and condensing olefins from the primary lean vapor stream in successive chilling and separation steps.

8. The method of claim 7, wherein the methane separation step comprises distilling methane from the olefins in a demethanizer distillation column.

9. The method of claim 7, further comprising the step of stripping methane and lighter components from the primary olefins condensate stream for feed to the methane separation step.

10. The method of claim 7, further comprising the step of subcooling the primary olefins condensate stream for the methane separation step.

11. The method of claim 7, including substantially separating $C_{4+}$ components from the treated furnace effluent stream in a depropanizer distillation column prior to the liquid injection step.

12. The method of claim 2, including substantially separating $C_{3+}$ components from the treated furnace effluent stream in a deethanizer distillation column prior to the liquid injection step.

13. The method of claim 11, including the steps of:

stripping the primary olefins condensate stream in a prestripper column to separate light components therefrom and produce an enriched condensate stream and a secondary lean vapor stream;

feeding the secondary lean vapor to the methane separation step; and feeding the enriched condensate stream to a deethanizer distillation column.

14. An olefins plant, comprising:

a furnace unit for cracking hydrocarbons and producing an effluent stream comprising hydrogen and olefins;

a line for injecting a liquid hydrocarbon conditioning stream into the effluent stream thereby producing a conditioned stream;

a series of cascaded condensers and vapor-liquid separators for condensing and recovering olefins from the conditioned stream, and producing a cooled olefin-lean vapor stream;

a methane separator for recovering a methane stream from the condensed olefins; and a refrigeration system for supplying the primary refrigerant to one or more of the cascaded condensers.

15. The olefins plant of claim 14, comprising a unit for treating the furnace effluent stream upstream from the liquid injection line, including a compressor and a drier in series.

16. The plant of claim 15, comprising a primary condenser operatively associated with a primary vapor-liquid separator for partially condensing olefins from the conditioned stream to produce a primary lean vapor stream for feed to the cascaded condensers and separators and a primary olefins condensate stream.

17. The plant of claim 16, wherein the methane separator comprises a demethanizer distillation unit.

18. The plant of claim 16, comprising a depropanizer distillation unit for substantially separating $C_4$ and heavier components from the treated furnace effluent before injection of the liquid hydrocarbon conditioning stream.

19. The plant of claim 18, including:

a prestripper for stripping the primary olefins condensate stream to substantially separate light end components therefrom and produce an enriched liquid stream and a secondary lean vapor stream;

a line for feeding the secondary lean vapor stream to the methane separation unit; and a line for feeding the enriched liquid stream to a deethanizer distillation column.

20. The plant of claim 15, further including:

a series of cascaded cross-exchangers for partially condensing olefins from a portion of the furnace effluent stream by heat exchange against the cooled olefins-lean vapor and recovered methane streams;

an expander for expanding and further cooling the olefins-lean vapor and recovered methane streams; and lines for directing the cooled olefins-lean vapor and recovered methane streams as heat exchange media to the cross-exchangers.

21. In a method for recovering olefins from a cracking furnace effluent stream containing olefins including the steps of condensing and recovering olefins from the furnace effluent stream through a series of chilling and vapor-liquid separation steps, including partially condensing olefins and heavier components from the furnace effluent stream in a primary chiller and recovering condensed olefins and lean vapor in a primary vapor-liquid separator and condensing and recovering olefins from the lean vapor stream through a series of secondary chilling and vapor-liquid separation steps, and distilling the recovered olefins in a demethanizer, the improvement comprising the step of:

injecting a liquid hydrocarbon conditioning stream into the furnace effluent stream prior to the olefin condensation steps.

22. The improvement of claim 21, wherein the liquid hydrocarbon conditioning stream comprises a $C_2$-lean hydrocarbon stream selected from the group consisting of a drier liquid stream, a $C_2$-lean deethanizer stream, and combinations of said drier and $C_2$-lean deethanizer streams.

* * * * *